US007478745B2

(12) United States Patent
Philips

(10) Patent No.: US 7,478,745 B2
(45) Date of Patent: Jan. 20, 2009

(54) CONTAINER AND BLANK HAVING EASY OPENING FEATURE

(75) Inventor: Nicholas A. Philips, Sugar Grove, IL (US)

(73) Assignee: International Paper Company, Loveland, OH (US)

( * ) Notice: Subject to any disclaimer, the term of this patent is extended or adjusted under 35 U.S.C. 154(b) by 0 days.

(21) Appl. No.: 11/395,754

(22) Filed: Mar. 31, 2006

(65) Prior Publication Data

US 2007/0228131 A1 Oct. 4, 2007

(51) Int. Cl.
*B65D 5/52* (2006.01)
*B65D 17/28* (2006.01)

(52) U.S. Cl. ..... 229/240; 206/736; 206/774; 229/242

(58) Field of Classification Search ..... 229/240, 229/242, 160.2, 906; 206/736, 766, 774
See application file for complete search history.

(56) References Cited

U.S. PATENT DOCUMENTS 2,005,135 A * 6/1935 Esterson ..... 229/242
2,975,954 A * 3/1961 Sparks et al. ..... 229/240
3,004,697 A * 10/1961 Stone ..... 229/242
3,526,353 A * 9/1970 Jaeschke ..... 229/240
3,692,226 A * 9/1972 Young et al. ..... 229/240
3,756,502 A * 9/1973 Swanson et al. ..... 229/242
3,917,158 A * 11/1975 Dorofachuk et al. ..... 229/240
5,012,929 A * 5/1991 Roosa ..... 229/240
5,209,392 A * 5/1993 Anatro ..... 229/117.01
5,555,982 A * 9/1996 Kuhn et al. ..... 229/240
6,464,132 B1 * 10/2002 Duquet et al. ..... 229/221
6,669,083 B2 * 12/2003 Bates ..... 229/240
6,729,475 B2 * 5/2004 Yuhas et al. ..... 206/746
6,832,683 B2 * 12/2004 Boriani et al. ..... 206/736
6,902,104 B2 * 6/2005 Holley et al. ..... 229/242

* cited by examiner

*Primary Examiner*—Gary E Elkins

(57) ABSTRACT

A container for storing and displaying produce made from a blank having a variety of side panels, top panels, and bottom panels. The various side panels are arranged such that one of the side panels and its associated top panel are attached to the adjoining side panels via separable perforation lines. Additionally, the two major top panels or designed to form an overlap area that helps prevent any sealing elements from contact any other panels thereby affecting the opening aspect of this container. As such, the top panel and the side panel may be easily pulled away from the rest of the container thereby providing easy access to the contents container therein. Once pulled away from the rest of the container, the top panel and the side panel may be folded around such that they form a leaning support for the container or removed altogether.

6 Claims, 4 Drawing Sheets

CONTAINER AND BLANK HAVING EASY OPENING FEATURE

FIELD OF THE INVENTION

This invention relates generally to shipping and display containers and blanks. Specifically, the present invention relates to a shipping container and blank for a shipping and display container that includes an easy opening feature.

BRIEF DESCRIPTION OF THE DRAWINGS

This invention is best understood from the following detailed description when read in connection with the accompanying drawings. It is emphasized that, according to common practice, various features of the drawings are not to scale. On the contrary, the dimensions of the various features are arbitrarily expanded or reduced for clarity. Included in these drawings are the following figures.

DETAILED DESCRIPTION

The present invention will now be described with reference to the accompanying FIGURES. The present invention is directed to a blank 20 and container 50 that utilizes a unique opening feature that allows easy access to a product (not shown) contained therein. One suitable embodiment of the blank 20 and container 50 that is constructed in accordance with aspects of the present invention is illustrated in FIGS. 1 through 6. Specific details of the blank 20 and the resulting container 50 are described in more particularity below.

Figure 1:
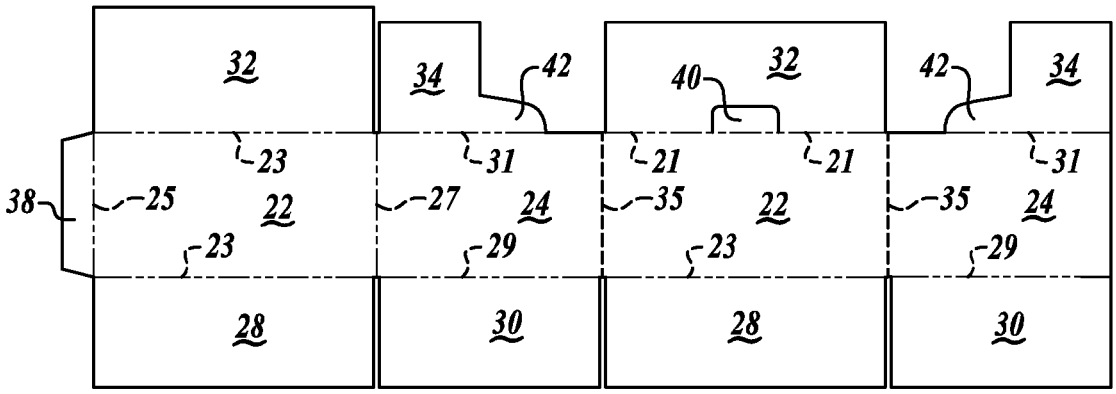
FIG. 1 is a plan view of an exemplary container blank.

FIG. 1 depicts a blank 20 used to form a container 50. The blank 20 is typically constructed from a single piece of formable material such as, without limitation, sheets of cellulose-based material formed from cellulose materials such as wood pulp, straw, cotton, bagasse, or the like. Cellulose-based materials used in the present invention may come in many forms, such as fiberboard, containerboard, corrugated containerboard and paperboard. However, it will be appreciated that the single piece of formable material may be constructed from other material as well, such as, without limitation, a polymer based material. The polymer based material may be in the form of a sheet of plastic material, or a sheet of corrugated plastic material.

The blank 20 is cut and scored, perforated or otherwise formed into a plurality of panels that, when assembled, form container 50. In all figures, like numbers indicate like parts; additionally, cut lines are shown as solid lines, score lines as dashed lines, and lines of perforation as broken lines. For the purposes of further description herein, the downward direction is defined as a direction perpendicular to the first bottom panel 28 when the container 50 has been erected. The upward direction is defined as the direction perpendicular to the first bottom panel 28 that corresponds to the inner surface of the bottom panel when the container 50 has been erected.

Referring now to FIG. 1, the blank 20 includes first side panels 22 and second side panels 24. One of the first side panels 22 is attached or coupled with one of the second side panels 24 along a fold line 27. The other first side panel 22 is connected to both second side panels 24 along perforation lines 35. One of the first side panels 22 may include a manufacturer's joint panel 38 that is connected to the first side panel along a fold line 25. Alternatively, it will be appreciated that the manufacture's joint panel 38 may be attached to one of the second side panel 24 (not shown). The first side panel 22 additionally includes a first bottom panel 28 attached along a fold line 23. Further, one first side panel 22 includes a first top panel 32 connected along a fold line 21. Additionally, the other first side panel 22 is connected with a third top panel 36 along a fold line 37.

The first top panel 32 and the third top panel 36 are of slightly different size. Specifically, in one embodiment the first top panel 32 is slightly larger than the third top panel 36. Conversely, in an alternative exemplary embodiment, the third top panel 36 may be slightly larger than the first top panel 32. In either case, the purpose of the respective size difference is to produce an overlap area 39 (best seen in FIG. 3) between the two panels. In this manner, when the container 50 is "sealed" the first top panel 32 and the third top panel 36 may be sealed such that the second top panels do not contact any of the sealing material. As will be described in more detail below, this will allow the first top panel 32 and the third top panel 36 to move independent from the second top panels 34.

The second side panel 24 includes a second bottom panel 30 attached along a fold line 29. Additionally the second side panel includes a second top panel 34 attached to the second side panel along a fold line 31. The second top panel may include a profile cut thereby reducing the overall length of the second top panel relative to the second side panel 24 some distance a measured along the fold line 31. The profile cut may be of any geometric shape. In on exemplary embodiment the profile cut is such that it leaves a first top panel extension 42.

With regard to the first side panel 22 that is connected to both the second side panels 24, and is bounded by perforation lines 35, this first side panel 22 includes a hand hold cut-out 40 formed at least partially within the third top panel 36. Additionally or alternatively, the hand hold cutout 40 may also be formed in this specific first side panel 22 (not shown). It will be appreciated by those skilled in the art that this specific first side panel 22, first top panel 32 and hand hold cut-out 40 are configured to allow the container to be opened more quickly and easily, as will be discussed in more detail below.

Figure 2:
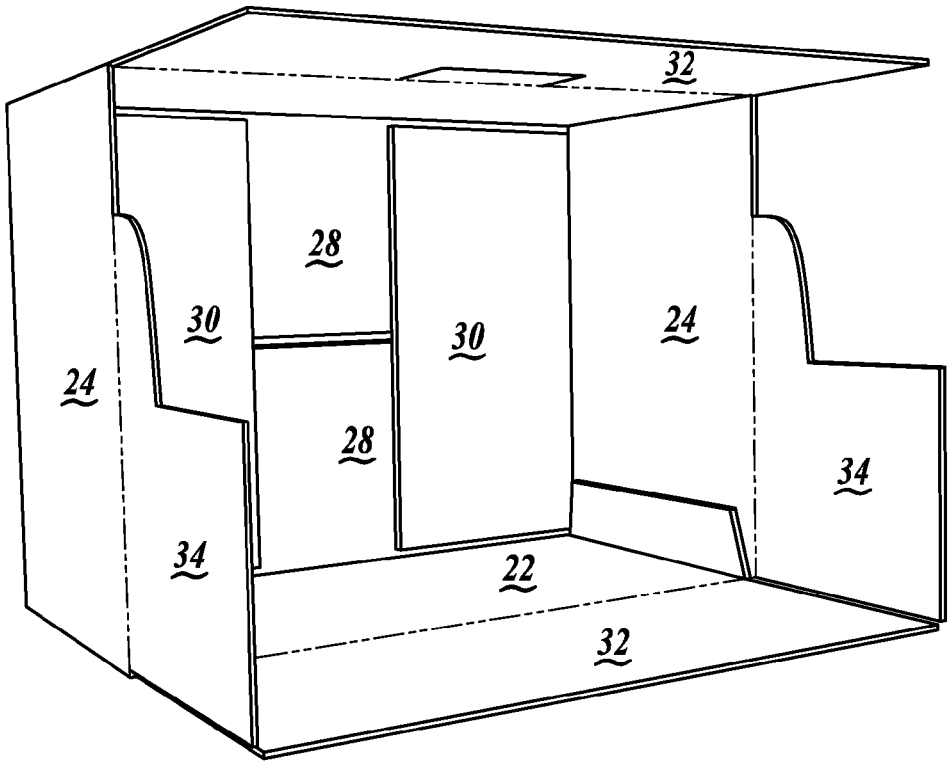
FIG. 2 is a perspective view of the partially assembled container made from the container blank of FIG. 1.
Figure 3:
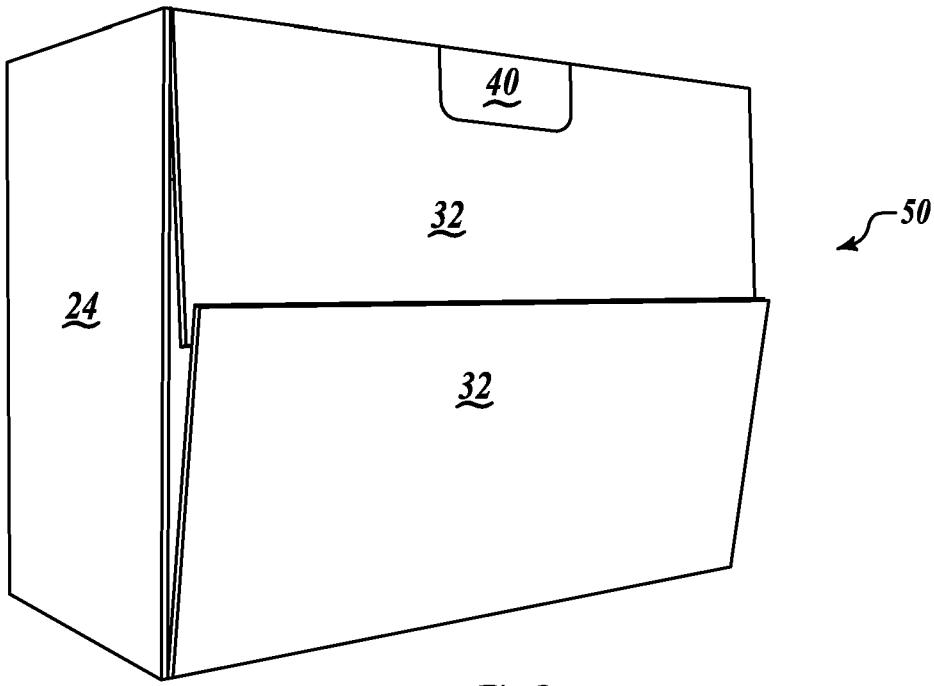
FIG. 3 is a perspective view of a more fully erect container formed from the container blank depicted in FIG. 1.

With respect to FIGS. 2 and 3, an exemplary embodiment of the erection of the container 50 is disclosed. Initially the first side panels 22 and second side panels 24 are folded around their respective fold lines and perforation lines such that the manufacturer's joint panel 38 is brought juxtaposed a portion of one of the second side panels 24 (or first side panels 22, depending upon original arrangement). The manufacturer's joint panel 38 may be coupled to the respective panel via any means known in the art, such as, without limitation, adhesives or mechanical fasteners or combinations thereof. Subsequently, the second bottom panels 30 may be folded upwardly approximately 90 degrees along a fold line 29. Then the first bottom panels 28 may be folded inwardly or upwardly approximately 90 degrees along a fold line 23. This arrangement is best shown in FIG. 2, wherein the bottom of the container 50 is shown as being substantially closed. These panels may be taped or otherwise joined together such as to seal off the bottom of the container. At this stage the container 50 is ready for filling of product (not shown).

Once the product (not shown) is placed into the container 50, the various top panels may be closed to seal the container. As best seen in FIG. 3, the second side panels 34 may be folded inwardly approximately 90 degrees along a fold line 31. Subsequently, the first top panel 32 may be folded inwardly along a fold line 21 to substantially close the container. Again the first top panel 32 may be taped or otherwise adhered to the third top panel 36 such that the container 50 effectively sealed in a manner such that the tape or other sealing element only contacts the first top panel 32 or the third top panel 36. However, it will be appreciated that the unique design of this blank 20 and container 50 is unique is unique in that the overlap area 39 helps prevents the tape or spot gluing (not shown) from contacting the second top panels 34 or the product container therein.

Figure 4:
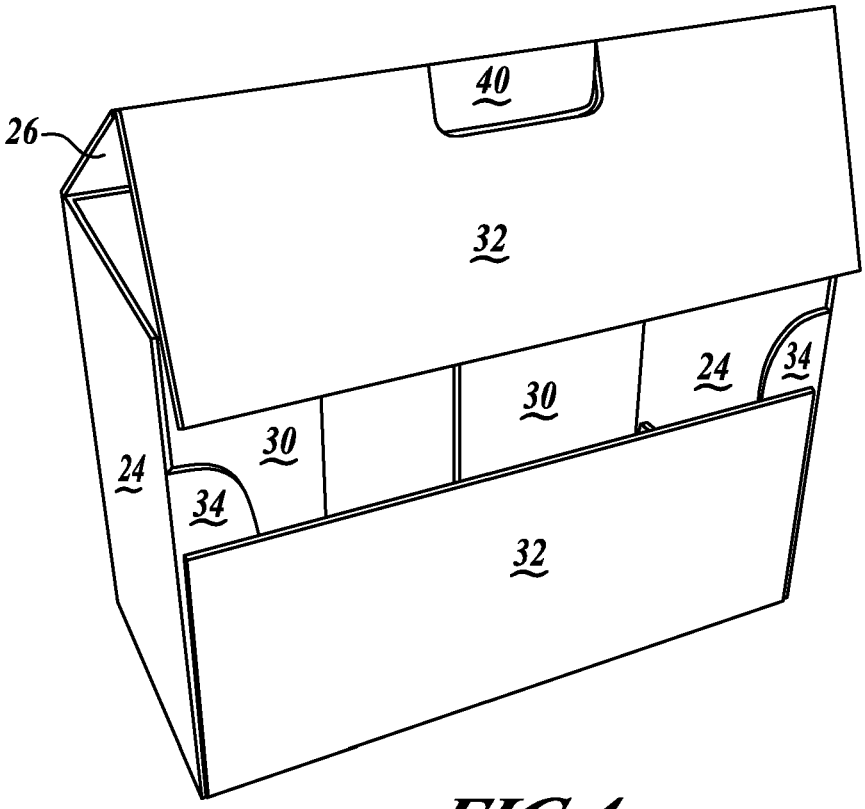
FIG. 4 is a perspective view of the container of FIG. 3 in a partially opened or closed state.
Figure 5:
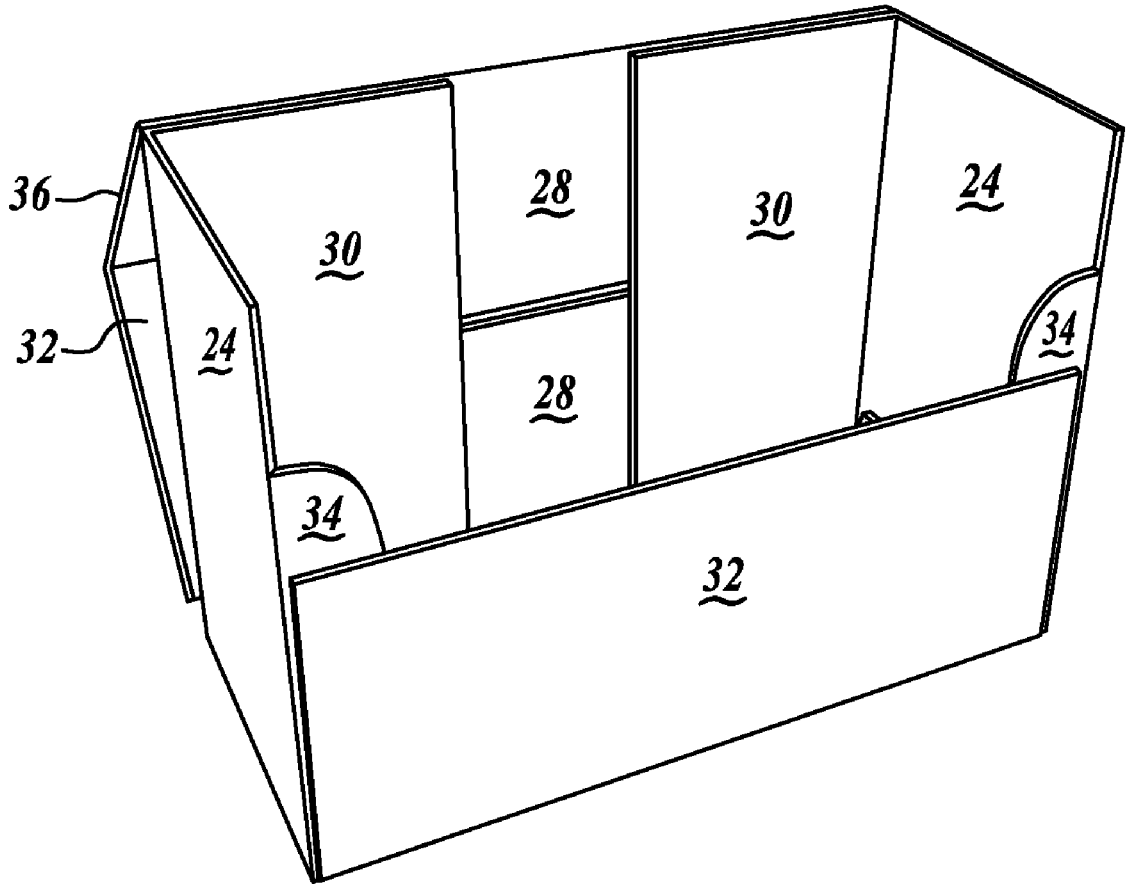
FIG. 5 is a perspective view of an aspect of the present invention.
Figure 6:
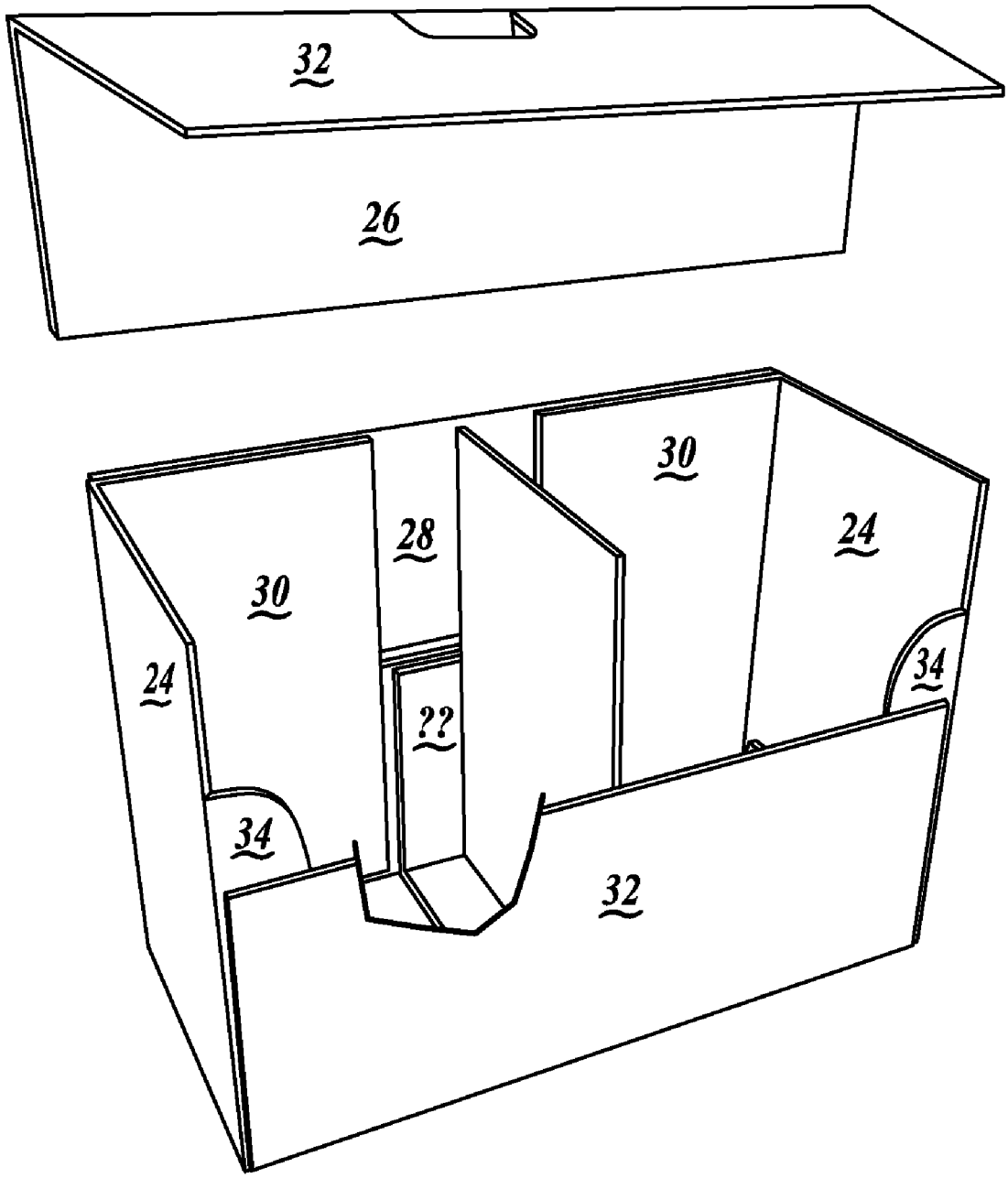
FIG. 6 is another perspective view of yet another aspect of the present invention.

With respect to FIGS. 4 through 6, various aspects of the easy opening feature of this container 50 are depicted. Specifically, hand hold 40 may be punched out in any suitable manner, thereby allowing the user to grasp the first top panel 32 and one of the first side panels 22. By applying a reasonable force to the hand hold 40, the user may separate the first side panel 22 separate from the second side panels 24 along perforation lines 35. As depicted in FIG. 5, the first top panel 32 and first side panel 22 may then be folded around fold line 23 such that the respective panels prop up the remaining portion of the container.

Additionally, in an alternative embodiment, the one specific fold line 23 that lies between the perforation lines 35 may also be a perforation line. As such, as best seen in FIG. 6, the entire first top panel 32 and first side panel 22 may be completely removed from the rest of the container 50. Those skilled in the art will appreciate that either of these arrangements are within the scope of this invention.

As further seen in FIG. 6, an optional divider panel 44 may be employed. The divider panel is well known in the industry as such that a detailed description is not necessary herein in order for those skilled in the art to appreciate the spirit and scope of this invention.

As noted above, the overall geometry of the various panels is not to be limited by the FIGURES. Specifically, the first side panels 22 are depicted as being rectangular; however, the first side panels may be any other geometric shape is without exceeding the spirit and scope of the present invention. For example, without limitation, the first side panels may be square. Likewise, the second side panels 24 may be taller or longer as the need arises. It will be appreciated that the geometry of the various top panels and bottom panels will be adjusted accordingly. Such modifications are within one skilled in the art and as such will not be discussed in detail herein.

While various embodiments of the invention have been illustrated and described, as noted above, many changes can be made without departing from the spirit and scope of the invention. Accordingly, the scope of the invention is not limited by the disclosure of such embodiments. Instead, the invention should be determined entirely by reference to the claims that follow.

What is claimed is:

1. A single sheet of foldable material cut and scored to define a container blank, comprising:

a first side panel;

a second side panel connected with the first side panel along a first perforation line; the second side and having a side edge opposite the first perforation line, a third side panel connected with the first side panel along a second perforation line, opposite said second side panel, a fourth side panel connected to the third side panel along a first fold line, a first top panel connected with the first side panel along a second fold line; the first top panel including a hand hole cut out formed within the first top panel and along the second fold line; the first top panel having an outer edge opposite the second fold line, the length of the first top panel being the distance between the second fold line and the first top panel outer edge, the length of the first top panel being less than the distance between the second perforation line and the first fold line and, a first bottom panel connected with the first side panel along a third fold line;

a second top panel connected with the second side panel along a fourth fold line, the second top panel being adjacent the second side panel side edge and being spaced from the first perforation line;

a third top panel connected with the third side panel along a fifth fold line, the third top panel being adjacent the first fold line and being spaced from the second perforation line;

a fourth top panel connected with the fourth side panel along a sixth fold line, the forth top panel having an outer edge opposite the sixth fold line, the length of the fourth top panel being the distance between the sixth fold line and the fourth top panel outer edge; the length of the first fourth panel being less than the distance between the second perforation line and the first fold line, the combined length of the first ton panel and the fourth top panel being greater than the distance between the second perforation line and the first fold line whereby the first and fourth top panels overlap in the closed container, the dimensions of the second, third and fourth top panels providing an opening in the top of a formed container when the first top panel is opened, wherein the first perforation line is parallel to the second perforation line throughout their respective lengths, and the first perforation line and the second perforation line extend between the first fold line and the second fold line.

2. The container blank of claim 1, wherein the single sheet of foldable material is formed from a cellulose-based material.

3. The container blank of claim 2, wherein the cellulose based material is formed from at least one of a wood pulp, straw, cotton, and bagasse.

4. The container blank of claim 2, wherein the cellulose based material is in the form of at least one of a fiberboard, containerboard, corrugated containerboard and paperboard.

5. The container blank of claim 1, wherein the single sheet of foldable material is formed from a polymer based material.

6. The container blank of claim 5, wherein the polymer based material is in the form of a plastic sheet or corrugated plastic sheet.

* * * * *

UNITED STATES PATENT AND TRADEMARK OFFICE

CERTIFICATE OF CORRECTION

PATENT NO. : 7,478,745 B2
APPLICATION NO. : 11/395754
DATED : January 20, 2009
INVENTOR(S) : Nicholas A. Philips It is certified that error appears in the above-identified patent and that said Letters Patent is hereby corrected as shown below:

Column 3 Claim 1, lines 62 & 63 through Column 4 Claim 1, lines 1 - 47, should be corrected as follows:

A single sheet of foldable material cut and scored to define a container blank, comprising:

a first side panel;

a second side panel connected with the first side panel along a first perforation line; the second side panel having a side edge opposite the first perforation line, a third side panel connected with the first side panel along a second perforation line, opposite said second side panel, a fourth side panel connected to the third side panel along a first fold line, a first top panel connected with the first side panel along a second fold line; the first top panel including a hand hole cut out formed within the first top panel and along the second fold line; the first top panel having an outer edge opposite the second fold line, the length of the first top panel being the distance between the second fold line and the first top panel outer edge, the length of the first top panel being less than the distance between the second perforation line and the first fold line and, a first bottom panel connected with the first side panel along a third fold line;

a second top panel connected with the second side panel along a fourth fold line, the second top panel being adjacent the second side panel side edge and being spaced from the first perforation line;

a third top panel connected with the third side panel along a fifth fold line, the third top panel being adjacent the first fold line and being spaced from the second perforation line;

a fourth top panel connected with the fourth side panel along a sixth fold line, the fourth top panel having an outer edge opposite the sixth fold line, the length of the fourth top panel being the distance between the sixth fold line and the fourth top panel outer edge; the length of the first fourth panel being less than the distance between the second perforation line and the first fold line,

UNITED STATES PATENT AND TRADEMARK OFFICE

CERTIFICATE OF CORRECTION

PATENT NO. : 7,478,745 B2
APPLICATION NO. : 11/395754
DATED : January 20, 2009
INVENTOR(S) : Nicholas A. Philips It is certified that error appears in the above-identified patent and that said Letters Patent is hereby corrected as shown below:

Column 3 Claim 1, lines 62 & 63 through Column 4 Claim 1, lines 1 - 47, should be corrected as follows: (continued)

the combined length of the first top panel and the fourth top panel being greater than the distance between the second perforation line and the first fold line whereby the first and fourth panels overlap in the closed container, the dimensions of the second, third and fourth top panels providing an opening in the top of a formed container when the first top panel is opened, wherein the first perforation line is parallel to the second perforation line throughout their respective lengths, and the first perforation line and the second perforation line extend between the first fold line and the second fold line.

Signed and Sealed this

Twenty-fifth Day of August, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,478,745 B2
APPLICATION NO. : 11/395754
DATED : January 20, 2009
INVENTOR(S) : Nicholas A. Philips It is certified that error appears in the above-identified patent and that said Letters Patent is hereby corrected as shown below:

Title Page; item (75);
The Office is hereby notified that Jeffrey M. Gardner and Walter D. Keefe, Jr. should be added as inventors of this patent as they were omitted without deceptive intent from the application hereto.

Signed and Sealed this

Ninth Day of February, 2010

David J. Kappos

David J. Kappos
*Director of the United States Patent and Trademark Office*